US010195468B2

(12) United States Patent
Allan et al.

(10) Patent No.: US 10,195,468 B2
(45) Date of Patent: Feb. 5, 2019

(54) GARMENT

(71) Applicant: Draeger Safety UK Limited, Blyth, Northumberland (GB)

(72) Inventors: Jason Edward Allan, North Shields (GB); Ian Douglas Tennick, Cramlington (GB)

(73) Assignee: DRAEGER SAFETY UK LIMITED, Blyth, Northumberland (GB)

( * ) Notice: Subject to any disclaimer, the term of this patent is extended or adjusted under 35 U.S.C. 154(b) by 427 days.

(21) Appl. No.: 14/613,892

(22) Filed: Feb. 4, 2015

(65) Prior Publication Data

US 2015/0231419 A1 Aug. 20, 2015

(30) Foreign Application Priority Data

Feb. 20, 2014 (GB) ..... 1403003.5

(51) Int. Cl.
*A62B 17/00* (2006.01)
*A62B 17/04* (2006.01)
(Continued)

(52) U.S. Cl.
CPC ..... *A62B 17/005* (2013.01); *A62B 7/02* (2013.01); *A62B 9/00* (2013.01); *A62B 9/02* (2013.01);
(Continued)

(58) Field of Classification Search
CPC ..... A62B 17/04; A62B 18/084; A62B 17/006; A62B 18/02; A62B 17/12104; A62B 7/02;
(Continued)

(56) References Cited

U.S. PATENT DOCUMENTS 2,573,414 A * 10/1951 Dunn ..... A41D 13/0025 128/201.29
2,657,396 A * 11/1953 Klein ..... A41D 13/0025 165/46
(Continued)

FOREIGN PATENT DOCUMENTS

| | | |
|---|---|---|
| CN | 101879360 A | 11/2010 |
| JP | 2003/027312 | 1/2003 |
| WO | 03/017790 | 3/2003 |

OTHER PUBLICATIONS

European Search Report dated Jul. 16, 2015 from corresponding EP Application No. 15153352.8.
(Continued)

*Primary Examiner* — Rachel T Sippel
*Assistant Examiner* — Tu Vo
(74) *Attorney, Agent, or Firm* — DLA Piper LLP (US)

(57) ABSTRACT

A temperature control garment arranged to be worn on a user's torso including a bladder defining a chamber for receiving a supply of gas, the bladder including a back portion which is arranged to overlie at least a portion of a user's back. An arrangement of holes is provided in the bladder for directing gas supplied to the chamber towards the user's body so as to modify the temperature of the user's body. The garment also includes a breathing duct coupled to the bladder for receiving a supply of gas, the breathing duct having at least one duct outlet for delivering the gas supplied to the breathing duct to the user.

19 Claims, 13 Drawing Sheets

(51) Int. Cl.
*A62B 9/04* (2006.01)
*A62B 9/00* (2006.01)
*A62B 7/02* (2006.01)
*A62B 9/02* (2006.01)
*A41D 13/002* (2006.01)

(52) U.S. Cl.
CPC ..... *A62B 9/04* (2013.01); *A62B 17/006* (2013.01); *A62B 17/04* (2013.01); *A41D 13/0025* (2013.01)

(58) Field of Classification Search
CPC .... A62B 7/12; A62B 9/00; A62B 9/04; A62B 17/00; A62B 17/001; A62B 17/003; A62B 17/08; A62B 18/00; A62B 18/003; A62B 18/006; A61M 16/0683; A61M 16/00; A61M 16/0666; A61M 16/0672; A41D 13/002; A41D 13/0053; A41D 13/0055; A41D 13/0056; A42B 3/322
USPC ..... 2/901, 457, 410
See application file for complete search history.

(56) References Cited

U.S. PATENT DOCUMENTS 2,773,262 A * 12/1956 Brouha ..... A41D 13/0025 2/81
3,049,896 A * 8/1962 Webb ..... A41D 13/0025 128/201.25
3,291,126 A * 12/1966 Messick ..... A41D 13/0053 128/201.29
3,468,299 A * 9/1969 Amato ..... A41D 13/0025 126/204
3,529,594 A * 9/1970 Charnley ..... A41D 13/0025 128/201.23
3,667,460 A * 6/1972 Shepard ..... A62B 18/04 128/201.15
3,804,086 A * 4/1974 Agnew ..... A41D 13/1209 128/202.19
4,019,508 A * 4/1977 Der Estephanian ..... A41D 13/1209 128/201.23
4,055,173 A * 10/1977 Knab ..... A41D 13/1153 128/201.23
4,194,247 A * 3/1980 Melander ..... A41D 13/0025 2/457
4,271,833 A * 6/1981 Moretti ..... A62B 17/006 128/201.28
4,513,452 A * 4/1985 Rankin, Sr. ..... A41D 13/0053 2/8.1
4,741,333 A * 5/1988 Suzuki ..... A41D 13/1209 128/201.23
4,914,752 A * 4/1990 Hinson ..... A41D 13/0025 2/457
4,964,282 A * 10/1990 Wagner ..... A41D 13/0025 2/DIG. 1
5,014,355 A * 5/1991 Vollenweider, II ..... A41D 13/0025 128/201.13
5,088,115 A * 2/1992 Napolitano ..... A41D 13/0025 2/69
5,133,344 A * 7/1992 Jurrius ..... A62B 17/04 128/201.23
5,421,326 A * 6/1995 Rankin ..... A41D 13/0053 128/201.11
5,533,354 A * 7/1996 Pirkle ..... A41D 13/0053 2/458
5,655,374 A * 8/1997 Santilli ..... A41D 13/1218 2/905
5,970,519 A * 10/1999 Weber ..... A41D 13/0025 2/102
2002/0029410 A1* 3/2002 Szymocha ..... A41D 13/0051 2/458
2003/0045918 A1* 3/2003 Turner ..... A61F 7/02 607/107
2004/0011073 A1* 1/2004 Blackstone ..... A41D 13/0055 62/420
2004/0168459 A1* 9/2004 Blackstone ..... A41D 13/0025 62/259.2
2004/0226558 A1* 11/2004 Kausch ..... A62B 17/005 128/201.29
2005/0016199 A1* 1/2005 Blackstone ..... A41D 13/0025 62/420
2005/0172655 A1* 8/2005 Naaman ..... A41D 13/0025 62/259.3
2005/0178138 A1* 8/2005 Blackstone ..... A41D 13/0025 62/259.3
2006/0026743 A1* 2/2006 Farnworth ..... A41D 13/0053 2/455
2006/0174392 A1* 8/2006 Farnworth ..... A41D 13/0025 2/102
2007/0079829 A1* 4/2007 Duke ..... A41D 13/0025 128/202.13
2008/0066484 A1* 3/2008 Blackstone ..... A41D 13/0053 62/421
2009/0044932 A1* 2/2009 Blackstone ..... A41D 13/0025 165/158
2009/0271917 A1* 11/2009 Richardson ..... A41D 13/0025 2/458
2010/0236267 A1* 9/2010 Korytnikov ..... F24F 5/0035 62/259.3
2010/0319381 A1* 12/2010 Hubler ..... A41D 13/0053 62/259.3
2013/0091624 A1* 4/2013 Czajka ..... A41D 13/1209 2/456
2014/0069617 A1* 3/2014 Shelton ..... F41H 1/02 165/120
2014/0201891 A1* 7/2014 Turner ..... A41D 13/0015 2/455

OTHER PUBLICATIONS

Great Britain Search Report dated Jul. 14, 2014 from corresponding GB Application No. 1403003.5.
Search Report dated Aug. 27, 2018, of counterpart Chinese Application No. 2015100805607.

* cited by examiner

GARMENT

CROSS-REFERENCE TO RELATED APPLICATIONS

The present application claims priority to GB 1403003.5 filed on 20 Feb. 2014, which is hereby incorporated by reference in its entirety for any and all purposes.

BACKGROUND

The invention relates to a temperature control garment arranged to be worn on a user's torso.

When working in a hazardous environment it may be necessary to wear a protection suit, such as a gas-tight chemical protection suit. If the protection suit is gas-tight, it is necessary to supply the wearer with clean breathable gas from a source of breathable gas, such as a cylinder. This allows the worker to safely work in the hazardous environment. In certain environments, for example tank cleaning, the worker may get uncomfortably, or dangerously hot, and it may therefore be necessary for the worker to rest periodically. This may be inefficient and/or inconvenient.

In order to maintain a safe and comfortable core body temperature, workers may wear a cooling jacket or vest that covers the majority of their torso. Many different types exist, but all typically comprise outer and inner layers sealed together to form a chamber, with a uniform arrangement of holes provided over the entire surface of the inner layer. Gas is supplied to the cooling jacket or vest which is directed to the wearer's body through the uniform arrangement of holes.

Whilst such a garment may be satisfactory, it may not be particularly comfortable to wear, especially if it is worn under a chemical protection suit. Further, if it is also necessary to supply clean breathable gas to the user, there may be a complicated or untidy arrangement of flexible fluid conduits.

It is therefore desirable to provide an improved temperature control garment.

According to an aspect there is provided a temperature control garment arranged to be worn on a user's torso, comprising: a bladder defining a chamber for receiving a supply of gas, the bladder comprising at least a back portion which is arranged to overlie at least a portion of a user's back; an arrangement of holes provided in the bladder for directing gas supplied to the chamber towards the user's body so as to modify the temperature of the user's body; and a breathing duct coupled to the bladder for receiving a supply of gas, the breathing duct having at least one duct outlet for delivering the gas supplied to the breathing duct to the user. The garment may be a flexible garment. The garment may further comprise left and right adjustable shoulder straps. The arrangement of holes may be concentrated in one or more targeted temperature control regions.

According to another aspect there is provided a temperature control garment arranged to be worn on a user's torso, comprising: left and right adjustable shoulder straps; a bladder defining a chamber for receiving a supply of gas, the bladder comprising at least a back portion which is arranged to overlie at least a portion of a user's back; and an arrangement of holes provided in the bladder for directing gas supplied to the chamber towards the user's body so as to modify the temperature of the user's body. The garment may further comprising a breathing duct coupled to the bladder for receiving a supply of gas, the breathing duct having at least one duct outlet for delivering the gas supplied to the breathing duct to the user. The arrangement of holes may be concentrated in one or more targeted temperature control regions.

According to yet another aspect there is provided a temperature control garment arranged to be worn on a user's torso, comprising: a bladder defining a chamber for receiving a supply of gas, the bladder comprising at least a back portion which is arranged to overlie at least a portion of a user's back; an arrangement of holes provided in the bladder for directing gas supplied to the chamber towards the user's body so as to modify the temperature of the user's body, wherein the arrangement of holes is concentrated in one or more targeted temperature control regions. The garment may further comprise a breathing duct coupled to the bladder for receiving a supply of gas, the breathing duct having at least one duct outlet for delivering the gas supplied to the breathing duct to the user. The garment may further comprise left and right adjustable shoulder straps.

The garment may be a harness-type garment. The garment may be a cooling or a heating garment. The garment may be arranged to be worn under a protective garment, such as a suit or jacket which may have a hood portion for covering a user's head.

The breathing duct may be coupled to the bladder such that it is in a fixed relationship with respect to the bladder. The breathing duct may be directly or indirectly attached to the bladder. For example, the breathing duct may be secured to the bladder or secured to an intermediate structure that is attached to the bladder. The breathing duct may be supported along the majority of its length. The breathing duct may be supported (directly or indirectly) by the bladder. The breathing duct may have a substantially rectangular cross-section. The breathing duct may have a substantially constant width. The breathing duct may comprise an open channel. The open channel may be covered or sealed by another part such as a flexible support. The breathing duct may be directly or indirectly coupled to the bladder. The breathing duct may be flexible and/or resilient. The breathing duct may be semi-rigid. This may mean that the breathing duct can support its own weight and therefore retains its shape. The breathing duct may be integrally formed, such as by injection moulding. The breathing duct may be formed from a plastics material. The breathing duct may longitudinally extend from a lower portion to an upper portion. The breathing duct may be arranged to extend from a lower portion of a user's back to an upper portion of a user's back. The breathing duct may be arranged to extend over the left and/or right shoulder of the user. The breathing duct may comprise left and right branches that are arranged to extend over the left and right shoulders of the user respectively. The left and right breaches may comprise one or more elbow portions that are inclined towards each other. The left and right branches may each be provided with one or more duct outlets. Each branch may have a plurality of duct, or air, outlets that are spaced from one another. The or each duct outlet may be arranged to direct gas towards the user's face.

The or each duct outlet may be arranged to discharge the gas supplied to the breathing duct into the ambient surroundings, such as a space surrounding the user's head. The or each duct outlet may be arranged to discharge the gas supplied to the breathing duct into the interior of a protective garment. The or each duct outlet may be a hole, opening or vent. The or each duct outlet may not be directly connected to a delivery device such as a hood or mask. The breathing duct may be separate from, or not directly attached to, a protective garment such as a suit.

The breathing duct may comprise a central duct portion which in use is substantially aligned with the user's spine. The central portion may extend from the bottom of the user's back to the top of the user's back. The breathing duct may comprise a duct inlet for receiving a supply of gas provided at a first, such as a lower, end. The or each duct outlet may be provided towards a second opposing end. There may be a plurality of duct outlets.

The garment may further comprise a manifold having a manifold inlet for receiving a supply of gas, and a manifold chamber outlet in fluid communication with the chamber for supplying gas to the chamber. The manifold may further comprise a breathing gas outlet in fluid communication with the breathing duct for supplying gas to the breathing duct. The manifold inlet may be provided with a gas connector to which a corresponding connector of a flexible conduit for supplying breathable gas can be connected. The gas connector may be located at the bottom of the garment and/or breathing duct. The manifold may be located towards the lower end of the garment. The manifold may comprise a gas distributor disposed within the chamber. The gas distributor may comprise a plurality of manifold chamber outlets. The gas distributor may extend transversely. The gas distributor may be disposed at the bottom of the bladder. The plurality of manifold chamber outlets may be transversely spaced. The apparatus may further comprise a distribution conduit disposed within the chamber and in fluid communication with a manifold chamber outlet. The distribution conduit may extend from a distribution conduit inlet at lower region of the chamber to distribution conduit outlet at an upper region of the chamber. There may be a plurality of distribution conduits. There may be two distribution conduits located at left and right sides respectively. The distribution conduits may be arranged to extend within the bladder over the left and right shoulders of a user.

The targeted temperature control regions may be selected from the group consisting of: a back region that in use is substantially aligned with at least a portion of a user's back; a left pectoral region that in use is substantially aligned with a user's left pectoral region; and a right pectoral region that in use is substantially aligned with a user's right pectoral region. The holes may be provided only in the one or more targeted temperature control regions. The cooling holes may be arranged such that in use they face the user's body.

The bladder may comprise a back portion arranged to overlie at least a portion of a user's back. The bladder may comprise left and right shoulder portions arranged to pass over a user's left and right shoulders respectively. The bladder may comprise left and right pectoral portions arranged to overlie at least a portion of a user's left and right pectoral regions respectively. The bladder may be defined by two layers such as an inner layer and an outer layer. One or both of the layers may be gas impermeable. The cooling holes may be formed or provided in the inner layer. In some embodiments the inner layer of the bladder may be made from a gas permeable material such as a woven fabric, a foam, or an open-cell material. The structure of the gas permeable material may provide the cooling holes. The bladder may comprise one or more adjustable vents that can be opened and closed. The or each adjustable vent may comprise an opening provided with a reclosable fastener, such as a zip.

The garment may further comprise a gas-permeable layer disposed on the inner side of the bladder. The permeable layer may comprise a foam or mesh. The permeable layer may be a three dimensional woven fabric. The permeable layer may act to diffuse or distribute gas supplied from the chamber. The permeable layer may be attached to the bladder. The permeable layer may be detachably attached.

The garment may further comprise a flexible support. The bladder may be supported by the flexible support. The bladder may be provided on the inner side of the flexible support. The bladder may be attached to the flexible support. The flexible support may comprise a back portion arranged to overlie at least a portion of a user's back. The flexible support may comprise left and right shoulder portions arranged to pass over a user's left and right shoulders respectively. The flexible support may comprise left and right pectoral portions arranged to overlie at least a portion of a user's left and right pectoral regions respectively. The flexible support may be a fabric, and may comprise a fabric panel. The bladder may be generally coextensive with the flexible support. The breathing duct may be supported by the flexible support along its length. The combination of the breathing duct and flexible support and/or bladder may be flexible. The combination of the breathing duct and flexible support and/or bladder may be flexible such that the garment can be adjusted so that the garment closely conforms to the user's body. The breathing duct may be fixedly attached to the flexible support and/or the bladder. In other words, the breathing duct may be attached to the flexible support in such a manner than it cannot be removed (or at least it is not intended to be removed). The breathing duct may be sealed to the flexible support. The breathing duct may be in the form of an open channel and the flexible support may seal the open channel. The breathing duct may be supported on the outer surface of the flexible support. The breathing duct may be attached to the outer surface of the flexible support. The permeable layer may be substantially coextensive with the flexible support.

According to yet another aspect there is provided a breathing apparatus garment arranged to be worn on a user's torso for supplying breathable gas to a user, comprising: a flexible support comprising at least a back portion which is arranged to overlie at least a portion of a user's back; and a breathing duct supported by the flexible support for receiving a supply of breathable gas, the breathing duct having at least one duct outlet for delivering the breathable gas supplied to the breathing duct to the user. The garment may be a harness-type garment. The garment may be arranged to be worn under a protective garment, such as a suit or jacket which may have a hood portion for covering a user's head. The garment may further comprise left and right adjustable shoulder straps.

The breathing duct may have a substantially rectangular cross-section. The breathing duct may have a substantially constant width. The breathing duct may comprise an open channel. The open channel may be covered or sealed by another part such as a flexible support. The breathing duct may be flexible and/or resilient. The breathing duct may be semi-rigid. This may mean that the breathing duct can support its own weight and therefore retains its shape. The breathing duct may be integrally formed, such as by injection moulding. The breathing duct may be formed from a plastics material. The breathing duct may longitudinally extend from a lower portion to an upper portion. The breathing duct may be arranged to extend from a lower portion of a user's back to an upper portion of a user's back. The breathing duct may be arranged to extend over the left and/or right shoulder of the user. The breathing duct may comprise left and right branches that are arranged to extend over the left and right shoulders of the user respectively. The left and right breaches may comprise one or more elbow portions that are inclined towards each other. The left and right branches may each be provided with one or more duct outlets. Each branch may have a plurality of duct, or air, outlets that are spaced from one another. The or each duct outlet may be arranged to direct gas towards the user's face.

The or each duct outlet may be arranged to discharge the gas supplied to the breathing duct into the ambient surroundings, such as a space surrounding the user's head. The or each duct outlet may be arranged to discharge the gas supplied to the breathing duct into the interior of a protective garment. The or each duct outlet may be a hole, opening or vent. The or each duct outlet may not be directly connected to a delivery device such as a hood or mask. The breathing duct may be separate from, or not directly attached to, a protective garment such as a suit.

The breathing duct may comprise a central duct portion which in use is substantially aligned with the user's spine. The central portion may extend from the bottom of the user's back to the top of the user's back. The breathing duct may comprise a duct inlet for receiving a supply of gas provided at a first, such as a lower, end. The breathing duct may be provided with a gas connector to which a corresponding connector of a flexible conduit for supplying breathable gas can be connected. The connector may be a quick release connector. The or each duct outlet may be provided towards a second opposing end. There may be a plurality of duct outlets.

The flexible support may comprise left and right shoulder portions arranged to pass over a user's left and right shoulders respectively. The flexible support may comprise left and right pectoral portions arranged to overlie at least a portion of a user's left and right pectoral regions respectively. The flexible support may be a fabric. The breathing duct may be supported by the flexible support. The breathing duct may be sealed to the flexible support. The breathing duct may be in the form of an open channel and the flexible support may seal the open channel. The breathing duct may be supported on the outer surface of the flexible support. The breathing duct may be attached to the outer surface of the flexible support.

The garment may further comprise a chest strap. The garment may further comprise a waist belt or an attachment for attaching a waist belt.

The invention also relates to personal protective equipment, comprising: a temperature control or breathing apparatus garment in accordance with any statement herein; and a protective garment arranged to be worn over the garment. The protective garment may be arranged to cover at least a user's torso. The protective garment may be a protective suit, such as a chemical protection suit, or a jacket. The protective garment may comprise a hood portion which is arranged to cover the user's head. The or each duct outlet may be arranged to discharge breathable gas supplied to the breathing duct into the protective garment. At least a portion of the duct including the or each duct outlet may be disposed within the protective garment. The personal protective equipment may further comprise a source of gas with a flexible conduit fluidically coupled between the source of gas and the garment. The source of gas may comprise a source of breathable gas.

The invention may comprise any combination of the features and/or limitations referred to herein, except combinations of such features as are mutually exclusive.

SUMMARY OF INVENTION

A temperature control garment arranged to be worn on a user's torso, comprising a bladder defining a chamber for receiving a supply of gas, the bladder comprising at least a back portion which is arranged to overlie at least a portion of a user's back an arrangement of holes provided in the bladder for directing gas supplied to the chamber towards the user's body so as to modify the temperature of the user's body; and a breathing duct coupled to the bladder for receiving a supply of gas, the breathing duct having at least one duct outlet for delivering the gas supplied to the breathing duct to the user.

Personal protective equipment, comprising a temperature control garment arranged to be worn on a user's torso having a bladder defining a chamber for receiving a supply of gas, the bladder comprising at least a back portion which is arranged to overlie at least a portion of a user's back an arrangement of holes provided in the bladder for directing gas supplied to the chamber towards the user's body so as to modify the temperature of the user's body; and a breathing duct coupled to the bladder for receiving a supply of gas, the breathing duct having at least one duct outlet for delivering the gas supplied to the breathing duct to the user; and a protective garment arranged to be worn over the temperature control garment.

A temperature control garment arranged to be worn on a user's torso, comprising left and right adjustable shoulder straps, a flexible support having at least a flexible back panel a bladder attached to the inner surface of the flexible support, the bladder defining a bladder chamber for receiving a supply of gas and having at least a back portion which is arranged to overlie at least a portion of a user's back an arrangement of holes provided in the bladder for directing gas supplied to the chamber towards the user's body so as to modify the temperature of the user's body; the arrangement of holes being concentrated in one or more targeted temperature control regions a flexible breathing duct coupled to the bladder for receiving a supply of gas, the breathing duct having at least one duct outlet for discharging gas supplied to the breathing duct into the surroundings; and a manifold having a manifold inlet connector which can be connected to a source of breathable gas, a manifold chamber outlet which opens into the bladder chamber, and a breathing gas outlet which opens into the breathing duct.

BRIEF DESCRIPTION OF THE DRAWINGS

Embodiments of the invention will now be described, by way of example, with reference to the accompanying drawings, in which.

DETAILED DESCRIPTION

Figure 1:
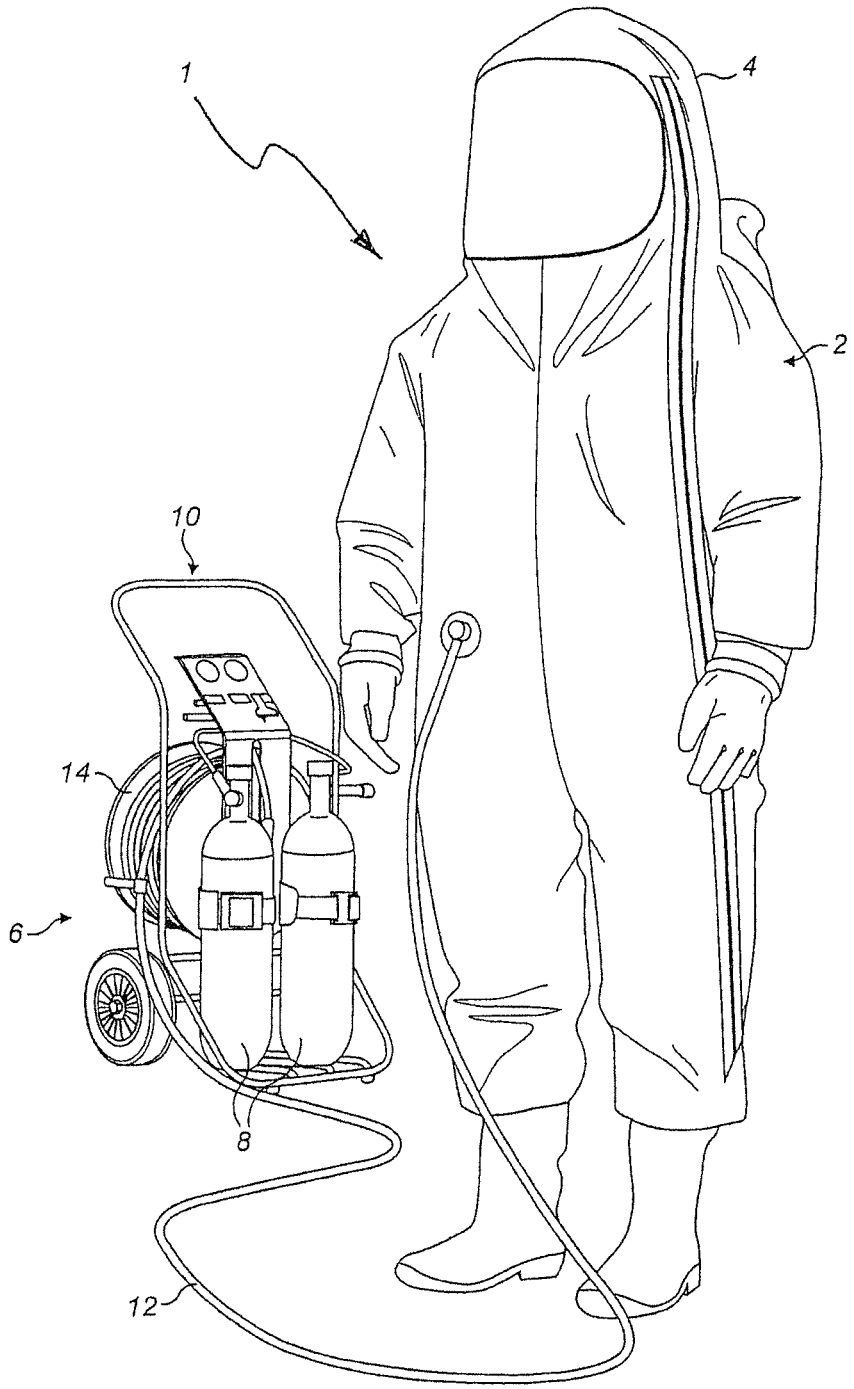
FIG. 1 schematically shows personal protective equipment including a source of breathable gas and a chemical protection suit.

FIG. 1 shows personal protective equipment 1 for a user comprising a protective suit in the form of a full gas-tight chemical protection suit 2, which is worn by the user, including a hood portion 4 which covers the user's head. The equipment 1 also comprises a source of breathable gas 6 in the form of two large cylinders 8 of breathable gas provided on a trolley 10. A flexible conduit 12, or hose, is fluidically connected to the source of breathable gas 6 and passes through the chemical protection suit 2 in a fluid-tight manner. The flexible conduit 12 is provided on a reel 14 which is attached to the trolley 10.

Figure 2:
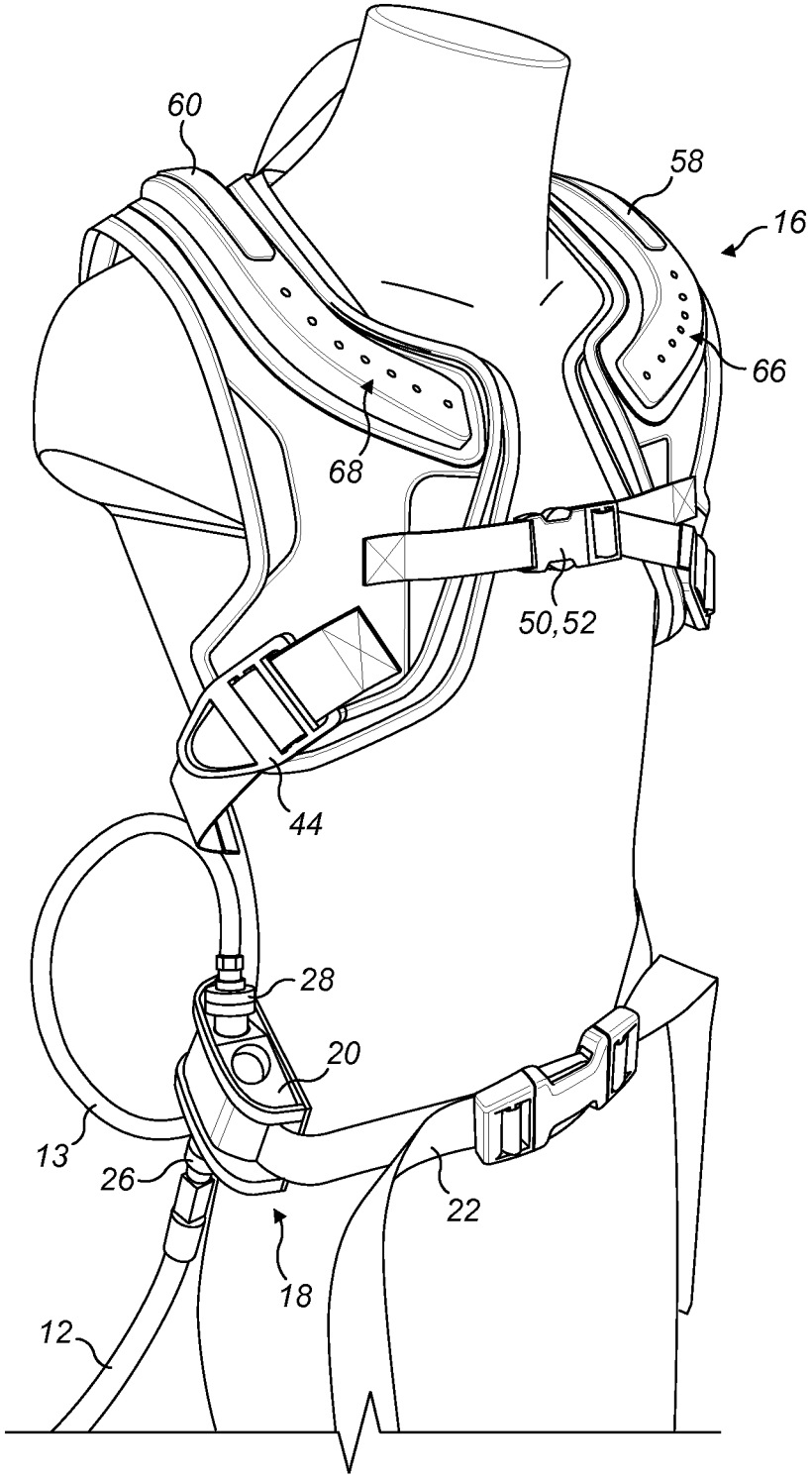
FIGS. 2, 3 and 4 schematically show a temperature control garment worn under the chemical protection suit of FIG. 1.
Figure 3:
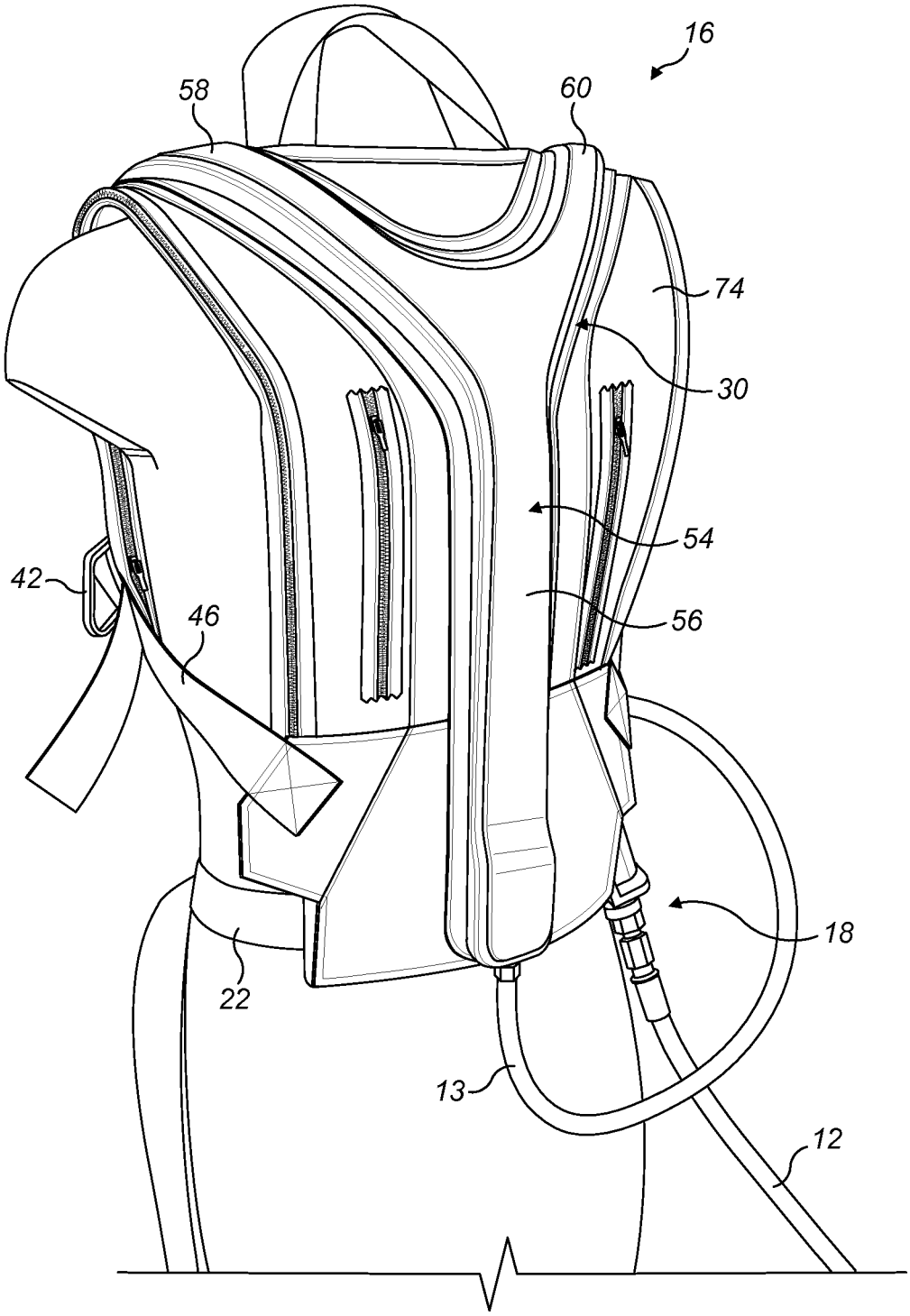
Figure 4:
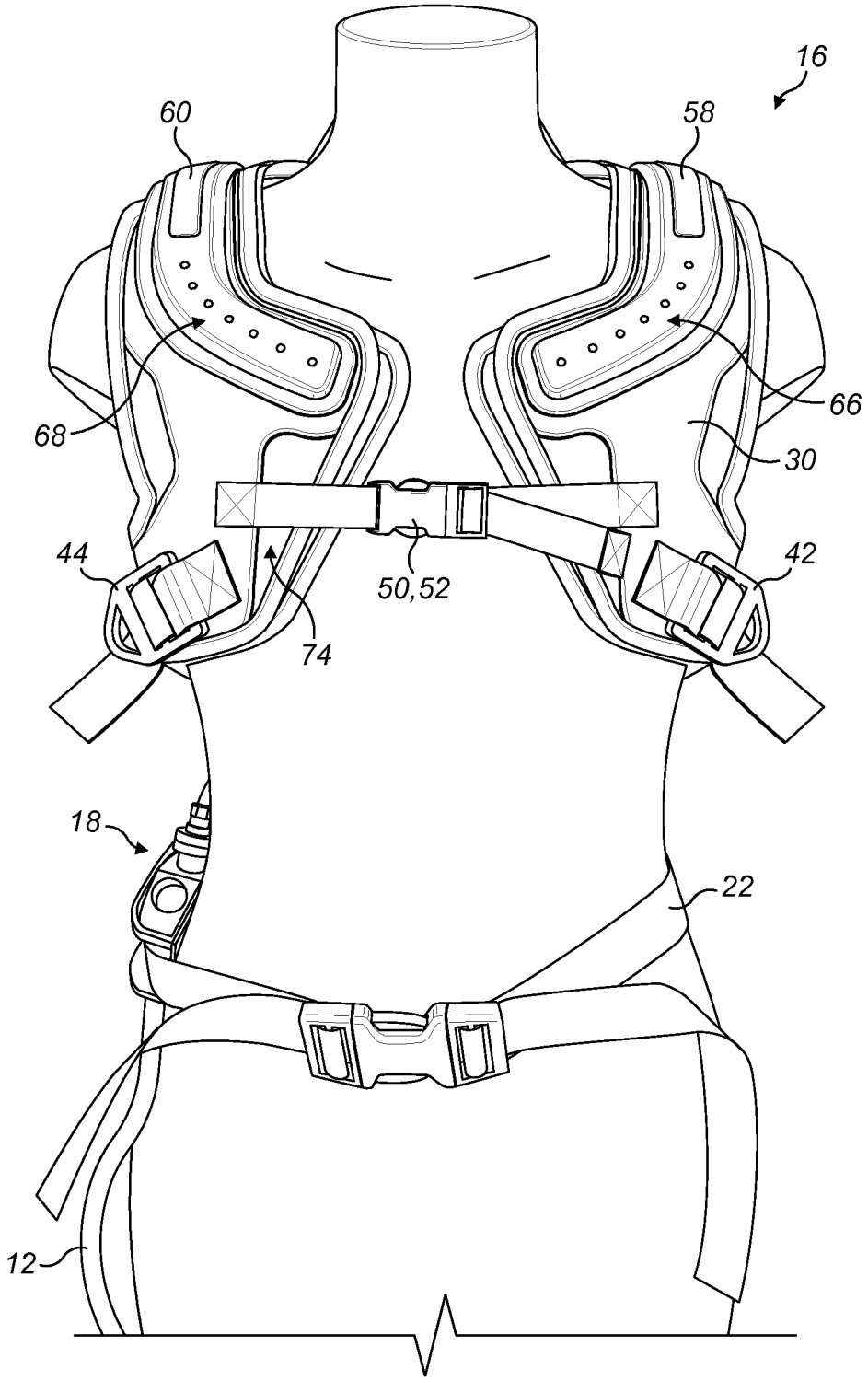
Figure 5:
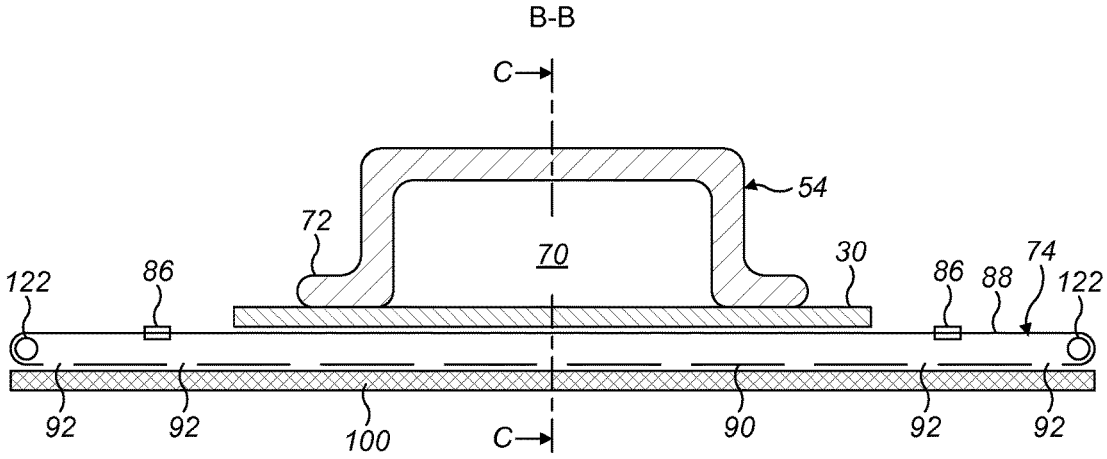
FIG. 5 schematically shows a first cross-sectional view of the temperature control garment along the line B-B (FIG. 7)
Figure 6:
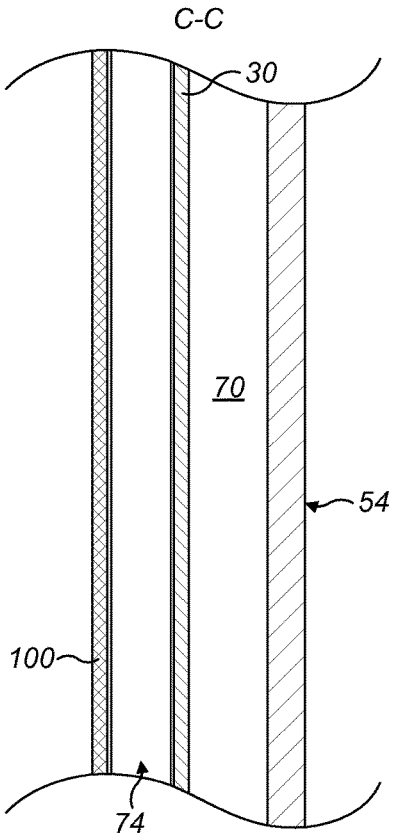
FIG. 6 schematically shows a second cross-sectional view of the temperature control garment along the line C-C (FIG. 7)

As shown in FIG. 2, underneath the chemical protection suit 2 a breathing apparatus harness-type temperature control garment 16 (herein after referred to as the "garment") is worn by the user, together with a waist mounted manifold 18. The waist mounted manifold 18 comprises a holder 20 attached to a waist belt 22, the holder 20 retaining a manifold 24 which in this embodiment has a manifold inlet port 26 and a manifold outlet port 28. The waist belt 22 cooperates with the garment 16 so that it acts as the waist belt of the garment 16. The waist mounted manifold 18 may be substantially as described in our co-pending United Kingdom patent application number 1303733.3, the entire contents of which is hereby incorporated by reference in its entirety for any and all purposes. The source of breathable gas 6 is fluidically connected to the manifold inlet 26 via the flexible conduit 12 and, as will be described in detail below, the manifold outlet 28 is fluidically connected to an inlet port (not shown in FIGS. 2 and 3) of the garment 16 with a shorter flexible conduit 13. Accordingly, breathable gas can be supplied from the gas cylinders 8 to the garment 16. As will be described in detail below, in this particular embodiment the garment 16 distributes the breathable gas supplied from the source of breathable gas 6 so that it can be breathed by the user, and so that it controls or moderates the body temperature of the user.

The personal protective equipment 1 allows a user to safely and comfortably work in hazardous environments for extended periods of time. Breathable gas is supplied from the source of breathable gas 6 to the garment 16 worn by the user such that the breathable gas can be breathed by the user, and the garment 16 also uses the breathable gas to control the body temperature of the user. Although it has been described that the protection suit 2 is gas-tight, it will be appreciated that this is in respect of ambient gas entering the suit 2. As well as clean breathable gas entering the protection suit 2 via the flexible conduit 12, it is also clearly possible for exhaled or used breathable gas to exit the chemical protection suit 2 through two exhalation ports provided in the suit.

As shown in FIGS. 3, 4 5 and 6, the garment 16 is a harness-type garment comprising a flexible support 30, a breathing duct 54, a bladder 74 and a diffuser layer 100. The bladder 74 is provided on and is attached to the inner side of the flexible support 30, whilst the breathing duct 54 is provided on and is attached to the outer side of the flexible support 30. The diffuser layer 100 is provided on the inner side of the bladder 74 such that the bladder 74 is disposed between the diffuser layer 100 and the flexible support 30. The garment 16 also comprises a number of fluid supply components that will be described in detail below.

Figure 7:
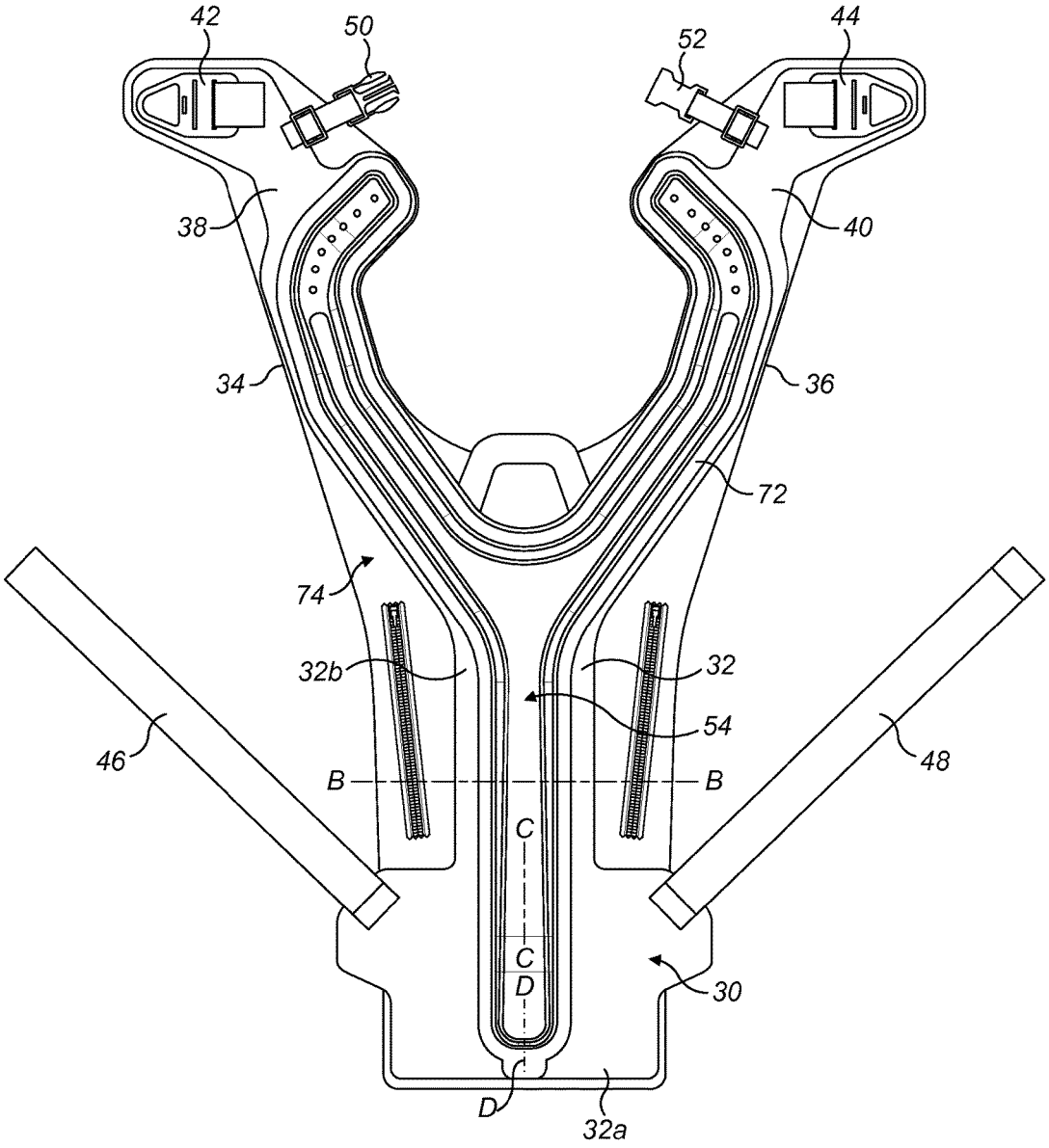
FIG. 7 schematically shows a front view of the temperature control garment.

Referring to FIG. 7, the main flexible support 30 is a continuous panel of a heavy-duty fabric and in this embodiment is made from 600d woven polyester. The flexible support 30 is a skeleton support and comprises a number of contiguous portions, or regions, including a back portion 32 which is arranged to cover (or overlie) a portion of a user's back, left and right shoulder portions 34, 36 which are arranged to pass over a user's left and right shoulders respectively, and left and right pectoral portions 38, 40 which are arranged to overlie at least a portion of a user's left and right pectoral regions respectively. The back portion 32 comprises a wider lumbar region 32*a* and a narrower spinal region 32*b*. The garment 16 also comprises left and right adjustable shoulder straps formed by left and right buckles 42, 44 and left and right straps 46, 48. The buckles 42, 44 are attached, such as by stitching, to the left and right pectoral portions 38, 40 of the flexible support 30, and the left and right straps 46, 48 are attached at a lower end, such as by stitching, to left and right sides of the lumbar portion 32*a* of the flexible support 30. The left and right straps 46, 48 cooperate with the left and right buckles 42, 44 respectively to form the adjustable shoulder straps. The overall length of the shoulder straps can be adjusted to alter the fit of the garment 16. An adjustable chest strap is also provided that comprises female and male cooperating buckles 50, 52 that are attached, such as by stitching, to the left and right pectoral regions 38, 40 respectively. In use, the chest strap can be fastened across the chest of the user to improve the comfort and/or fit of the garment 16.

As opposed to being a flexible panel of fabric, the flexible support 30 could be manufactured from a resilient material with the flexible support 30 having a pre-defined shape which retains an operational configuration when not worn. This may improve the fit of the garment 16 and may make it easier to don the garment 16.

Figure 8:
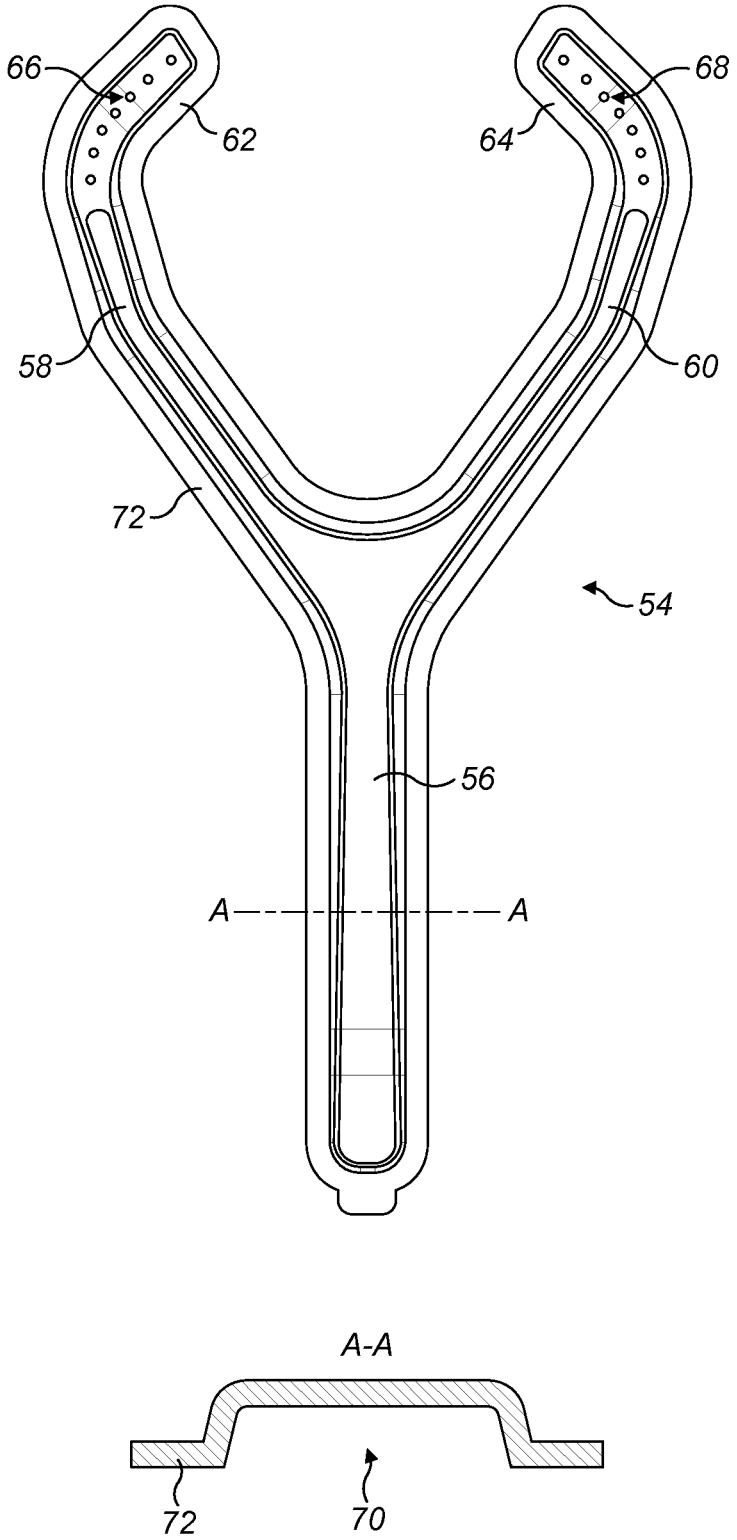
FIG. 8 schematically shows a front view of the breathing duct of the temperature control garment.

Referring to FIG. 8, the breathing duct 54 is a flexible, integrally formed injection-moulded component made from silicone rubber. Whilst the breathing duct 54 is flexible, it is considered to be "semi-rigid" inasmuch as it maintains its shape under its own weight. The breathing duct 54 comprises a main longitudinally extending central section 56 and splits into left and right branches 58, 60, thereby forming a "Y-shape". As will be described in detail below, the lower end of the central section 56 forms a duct inlet (not shown) for receiving a supply of breathable gas. The left and right branches 58, 60 each have an elbow section 62, 64 that are inclined towards each other. The duct 54 is substantially symmetric about a longitudinal axis that is aligned with the central portion 56. The left and right braches 58, 60, particularly in the region of the elbow sections 62, 64, are each provided with a plurality of duct, or air, outlets (or openings or holes) 66, 68. The air outlets 66, 68 are located in a line side-by-side and are substantially equally spaced from one another. The outlets 66, 68 are in the form of through-holes that extend through the wall of the breathing duct 54. The air outlets 66, 68 therefore provide fluid communication between the interior of the breathing duct 56 and the outside.

As can be seen from the sectional view along the line A-A, the breathing duct 54 forms an open channel 70 and is provided with a flange 72 around its entire periphery.

Referring back to FIG. 7, the breathing duct 54 is attached to the flexible support 30. In this embodiment, the flange 72 of the breathing duct 54 is stitched and sealed to the flexible support 30 so that the flexible support 30 closes the open channel 70 defined by the duct 54. The central duct section 56 extends from a lower portion of the back portion 32 to an upper portion thereof, the left and right braches 58, 60 are attached to and extend over the shoulder portions 34, 36, and the elbow sections 66, 68 overlie and are attached to the pectoral portions 38, 40.

Figure 9:
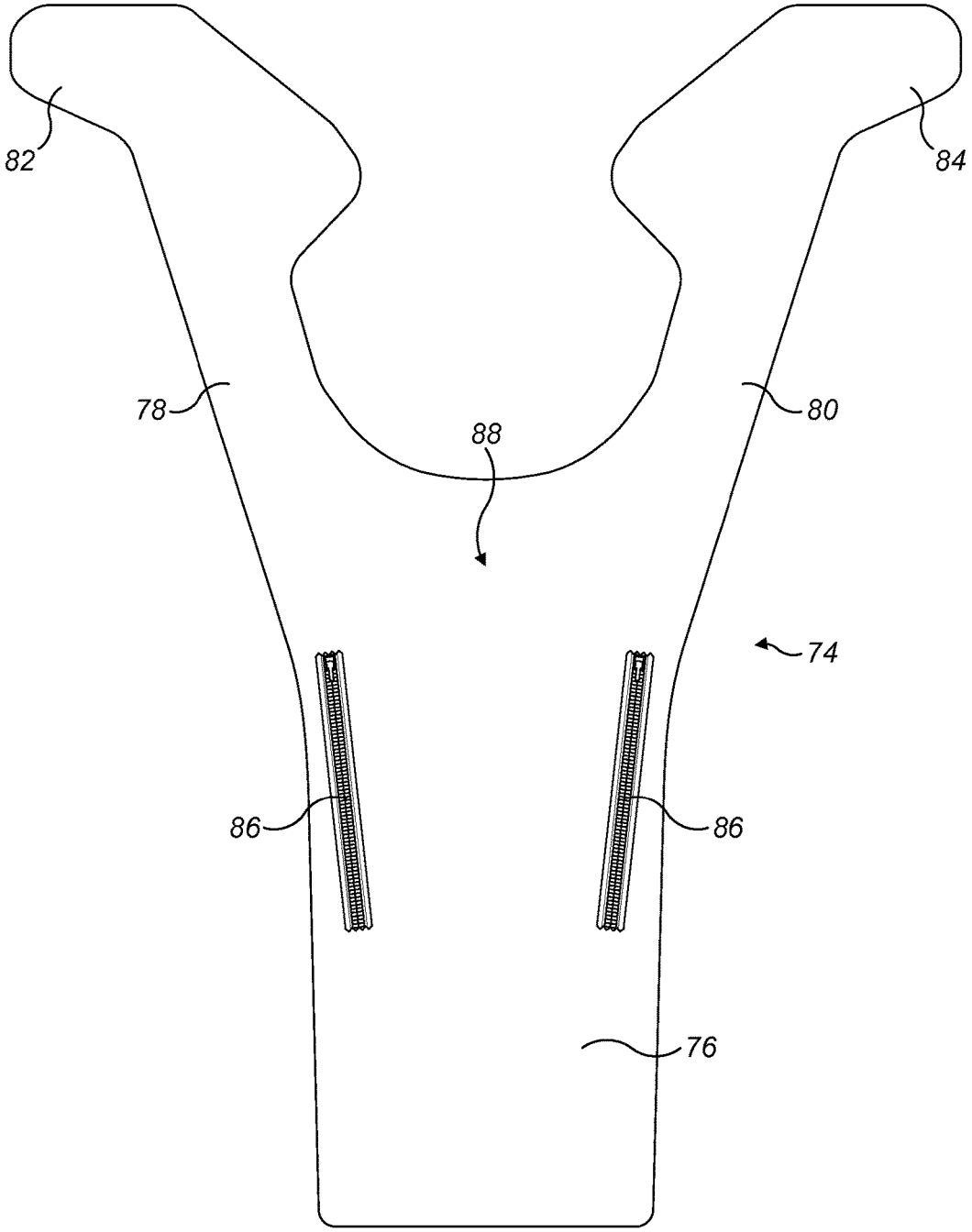
FIG. 9 schematically shows a front view of the bladder of the temperature control garment.

The bladder 74 is attached to and supported on the inner surface of the flexible support 30. In this embodiment the bladder 74 is stitched to the flexible support 34, but it could be attached in any suitable manner, for example by bonding. The bladder 74 defines a chamber, or plenum, for receiving a supply of breathable gas. The bladder 74 is a flexible two-layered structure and in this embodiment is made from polyurethane (PU) or polyvinylchloride (PVC). The two layers 88, 90 forming the bladder 74 are of substantially the same shape and size and are joined at their periphery to define the chamber. Referring to FIG. 9, the bladder 74 comprises a back portion 76, left and right shoulder portions 78, 80, and left and right pectoral portions 82, 84. The back portion 76 is arranged to overlie at least a portion of the user's back, the left and right shoulder portions 78, 80 are arranged to extend over the user's left and right shoulders respectively, and the left and right pectoral portions 82, 84 are arranged to overlie at least a portion of the user's left and right pectoral regions respectively. The bladder 74 comprises two adjustable vents 86 in the form of zips that are provided in the outermost layer 88 of the bladder 74. These can be opened or closed to control the flow of gas within the chamber defined by the bladder 74. Further, the vents 86 can be opened after the garment 16 has been cleaned in order to reduce the drying time.

Figure 10:
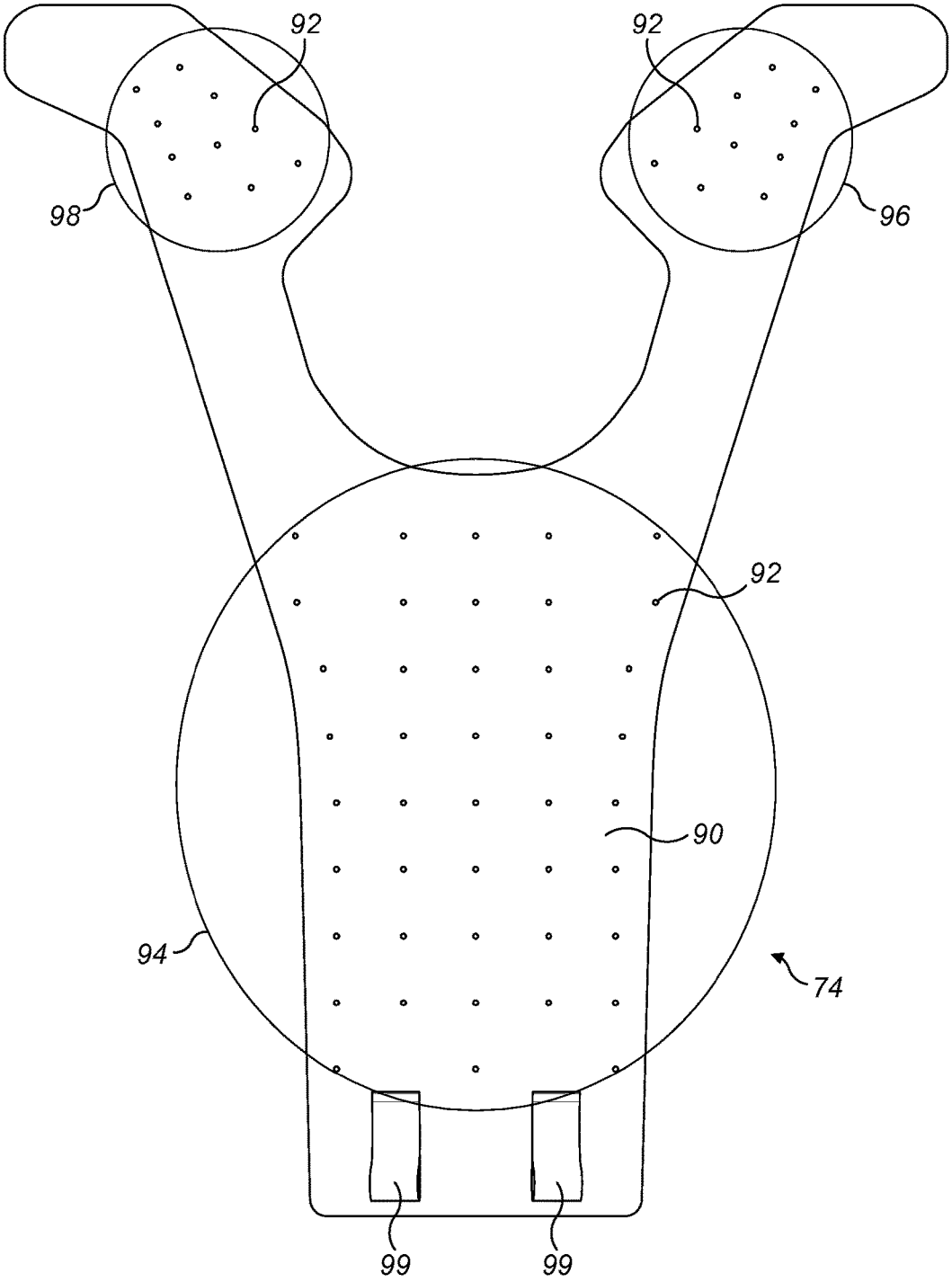
FIG. 10 schematically shows a rear view of the bladder of the temperature control garment.

As shown in FIG. 10, the inner layer 90 of the bladder 74 is provided with an arrangement of cooling holes 92 that are through-holes, or perforations, formed in the inner layer 90. The cooling holes 92 therefore provide fluid communication between the interior of the bladder 74 (i.e. the chamber) and allow breathable gas within the bladder 74 to exit. In this embodiment, the arrangement of cooling holes 92 are arranged in three targeted temperature control regions; namely, a back region 94 which is arranged to overlie at least a portion of a user's back, a left pectoral region 96 which is arranged to overlie a least a portion of a user's left pectoral region, and a right pectoral region 98 which is arranged to overlie a least a portion of a user's right pectoral region. The targeted temperature control regions are chosen to achieve maximum cooling efficiency. The cooling holes 92 have a diameter of approximately 3 mm and the holes are arranged in a square grid spaced by 40 mm in all directions. In this embodiment, the cooling holes 92 are only provided in the targeted temperature control regions. The rear of the bladder 74 is also provided with two waist belt attachment loops 99, the function of which will be described below. In other embodiments the bladder 74, or the inner layer 90 of the bladder 74, could be made from a gas-permeable woven fabric layer with the weave of the fabric providing the cooling holes 92. Alternatively, the inner layer 90 could be made from a foam material or an open-cell material, with the inherent properties of the material providing the cooling holes 92.

Referring back to FIG. 7, the bladder 74 is attached to the inner surface of the flexible support and is substantially aligned with it. Specifically, the back portion 32 of the flexible support 30 is aligned with the back portion 76 of the bladder 74, the left and right shoulder portions 34, 46 of the flexible support 30 are aligned with the left and right shoulder portions 78, 80 of the bladder 74, and the left and right pectoral portions 38, 40 are aligned with the left and right pectoral portions 82, 84 of the bladder 74.

Figure 11:
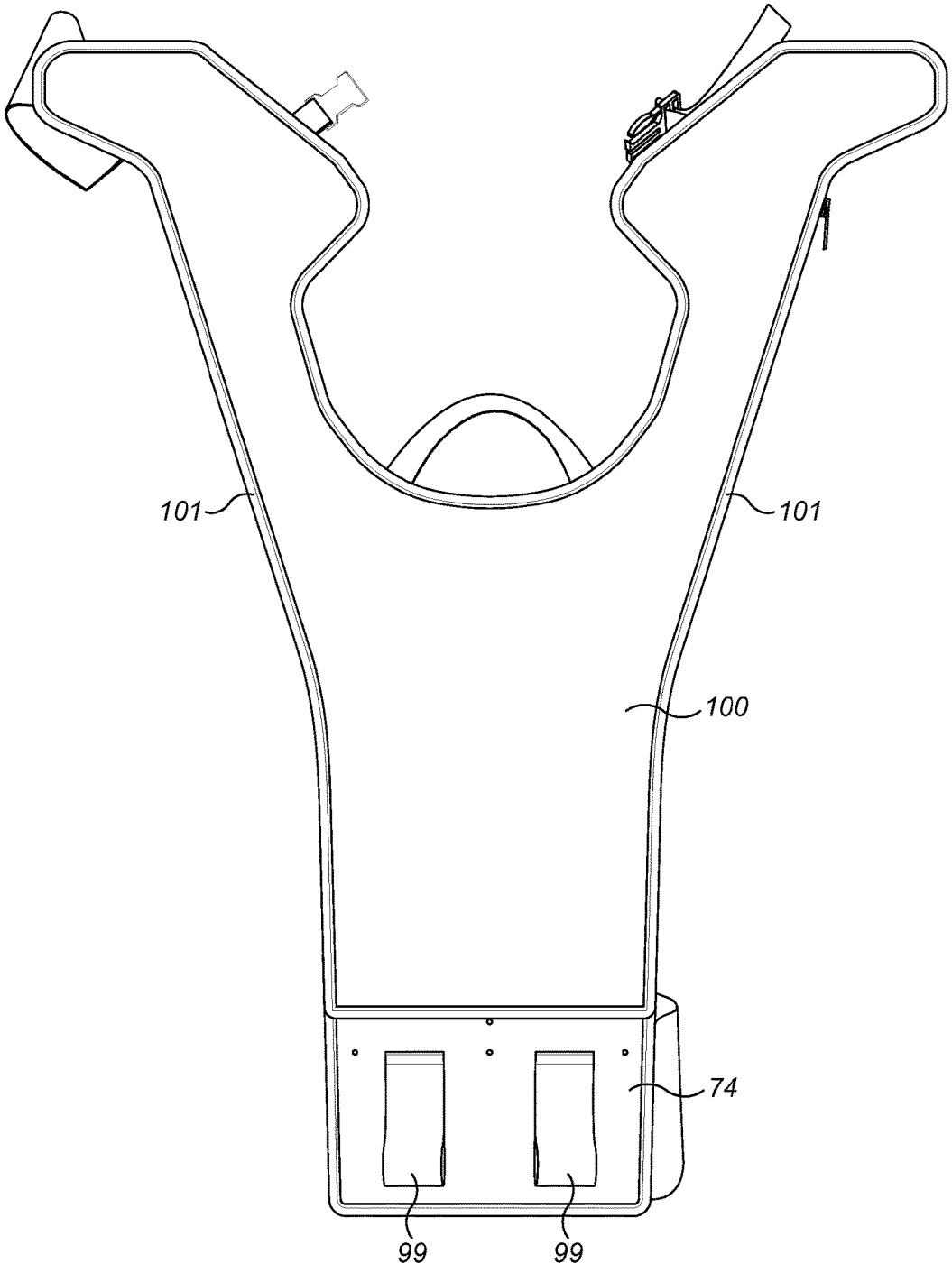
FIG. 11 schematically shows a rear view of the temperature control garment.

As shown in FIG. 11, the garment 16 also comprises a diffuser layer 100 which in this embodiment is in the form of a gas-permeable layer. The diffuser layer 100 in this embodiment is a three-dimensional woven fabric. The diffuser layer 100 is substantially the same shape and size as the bladder 74 and has a back portion, left and right shoulder portions and left and right pectoral portions. However, the diffuser layer 100 does not cover the waist belt attachment loops 99. The diffuser layer 100 is detachably attached to the bladder with zips 101. This allows the diffuser layer 100, which in use is in contact with the user, to be detached and washed. The bladder 74 is disposed between the flexible support 30 and the diffuser layer 100.

Figure 12:
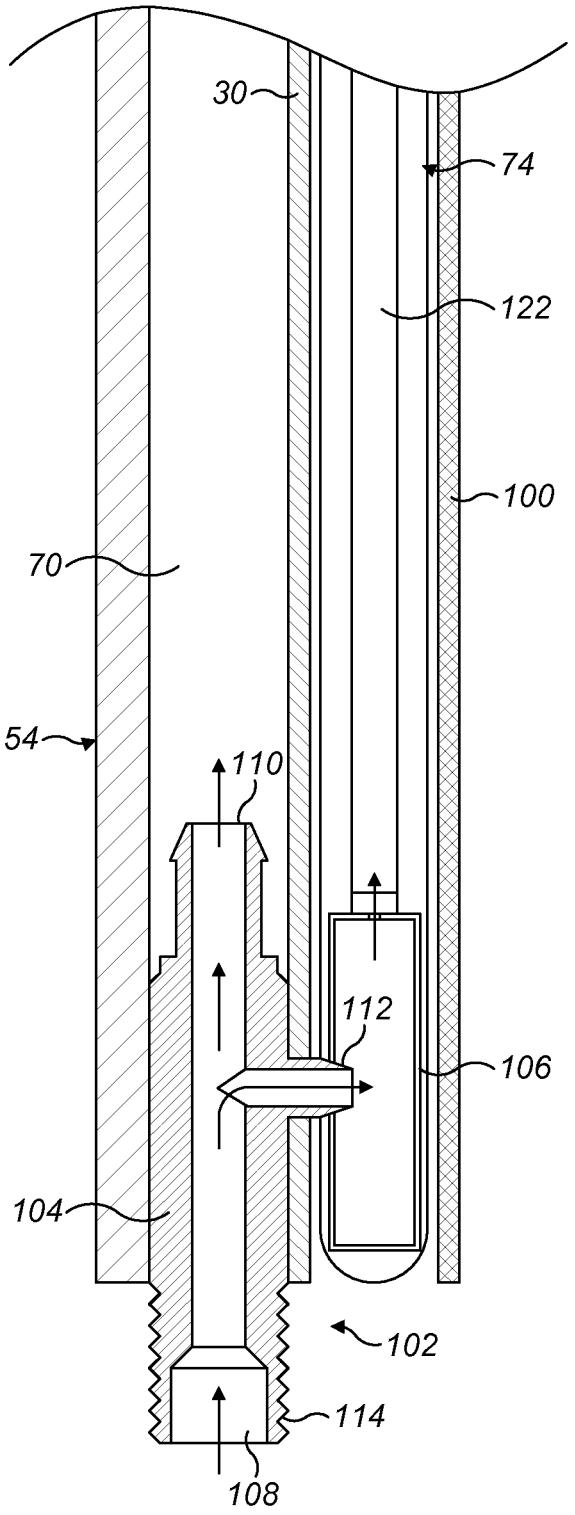
FIG. 12 schematically shows a cross-sectional view of a lower part of the garment showing various fluidic components along the line D-D (FIG. 7)

With reference to FIG. 12, the garment 16 also comprises a number of fluid supply components for supplying and distributing within the garment 16 the breathable gas from the supply of breathable gas 6. A manifold 102 is provided which comprise a T-piece 104 located within and at the lower end of the breathing duct 54 and a gas distributor 106 disposed within a lower portion of the bladder 74. The T-piece 104 comprises a breathable gas inlet 108, a breathable gas outlet 110 and a distributor outlet 112. The T-piece 104 is fluidically sealed within a lower portion of the breathing duct 54 and is located inside the channel 70. The breathable gas inlet 108 is provided with a connector 114 which is located outside of the breathing duct 54 and a flexible conduit 13 supplying breathable gas can be fluidically connected to it. The breathable gas outlet 110 is coaxial with the inlet 108 and is disposed within the channel 70 of the breathing duct 54 in a region which forms a duct inlet. The distributor outlet 112 is in fluid communication with both the inlet 108 and the outlet 110 and passes through an opening in the flexible support 30 and the outer panel 88 of the bladder 74 such that it extends into the bladder 74. The distributor outlet 112 is sealed to the flexible support 30 and the outer panel 88 of the bladder 74.

Figure 13:
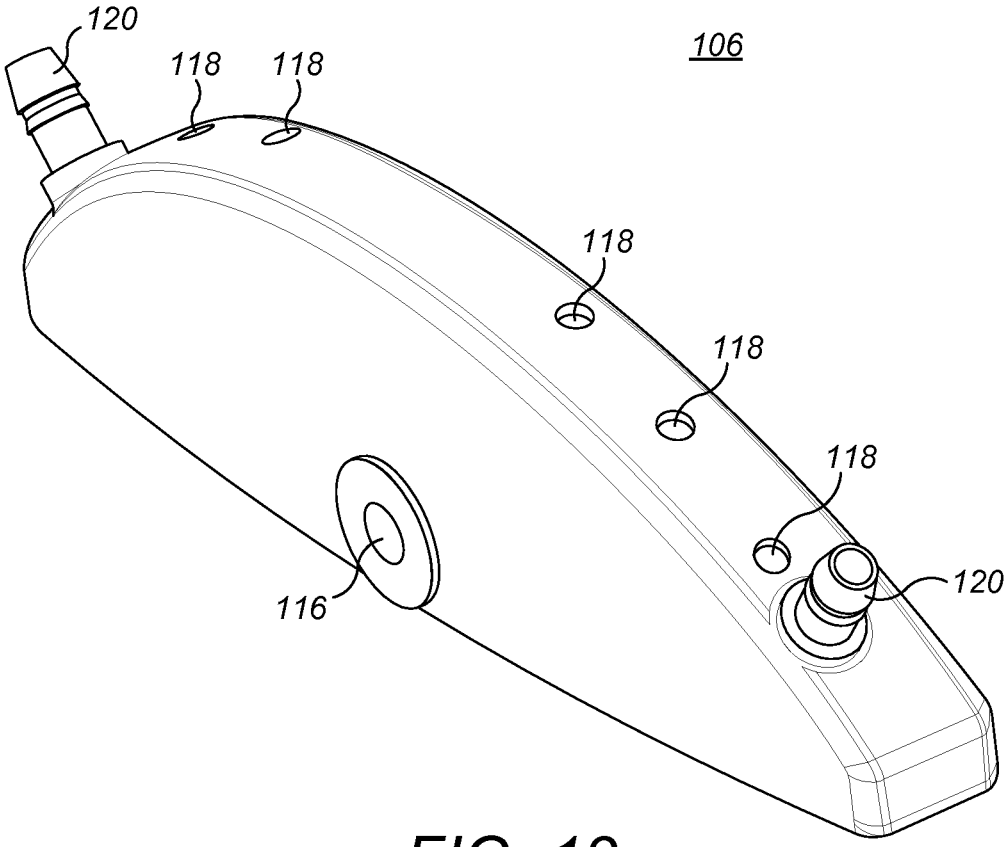
FIG. 13 schematically shows a perspective view of the gas distributor.
Figure 14:
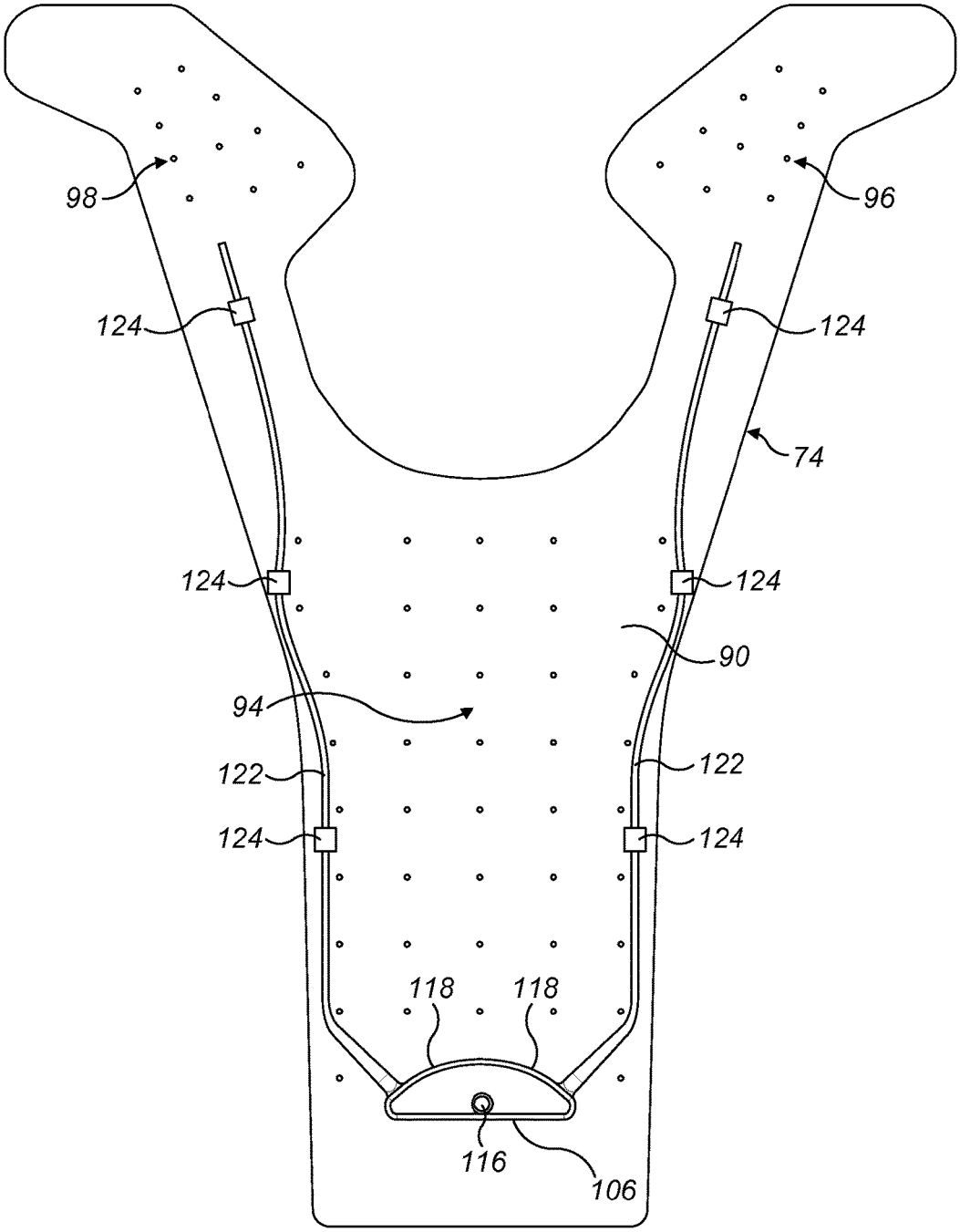
FIG. 14 schematically shows a view inside the bladder of the temperature control garment.

FIGS. 13 and 14 shows the gas distributor 106 which is a plastic injection moulded component. The gas distributor 106 is a hollow component and has an opening 116 in a side wall within which the gas distributor outlet 112 is received and sealed. The upper part of the gas distributor 106 is provided with a plurality of spaced manifold chamber outlets 118 in the form of through-holes leading to the interior of the gas distributor 106. The gas distributor 106 is also provided with first and second distribution ports 120 that are in fluid communication with the interior of the gas distributor 106. Referring to FIG. 14, a flexible distribution conduit 122 is fluidically coupled to each distribution port, and the distribution conduits 122 are disposed within and extend within the bladder 74 to an upper region thereof. Specifically, in this embodiment the distribution conduits 122 terminate in the region of the pectoral portions 82, 84 of the bladder such that the outlets of the conduits 122 are adjacent to the left and right pectoral temperature control regions 96, 98. The distribution conduits 122 are held in place by one or more clips or fixings 124.

Referring back to FIG. 2, in use, a user connects a flexible fluid conduit 13 between the outlet 28 of the waist mountable manifold 24 and the fluid inlet connector 114 of the garment 16. The waist belt 22 is then passed through the waist belt attachment loops 99 so that the waist mounted manifold equipment 18 is coupled to the harness-type breathing/cooling garment 16. The user then dons the harness-type garment 16 and adjusts the left and right adjustable shoulder straps 42, 44, 46, 48, the waist belt 22 and the chest strap 50, 52 to achieve the desired fit. As opposed to using the waist belt 22 of the manifold equipment 18, the garment 16 could be provided with its own waist belt or strap. When correctly worn and fitted, the back portion 76 of the bladder 74 overlies the user's back, the left and right shoulder portions 78, 80 of the bladder 74 extend over the user's left and right shoulders respectively, and the left and right pectoral portions 82, 84 of the bladder 74 overlie the user's left and right pectoral regions. Thus, the targeted cooling regions 94, 96, 98 formed by the cooling holes 92 are aligned with the user's back, left pectoral region and right pectoral region. The diffuser layer 100 is in close contact with the user's clothing or body.

The user then dons the gas-tight chemical protection suit 2 which is worn over the breathing/cooling garment 16. A flexible conduit 12 which is connected at a first end to the source of breathable gas 6 is then passed in a fluid-tight manner through a seal in the chemical protection suit and is attached to the inlet 26 of the waist mountable manifold 24. This allows breathable gas to be supplied from the source of breathable gas 6 to the garment 16. Additional protective clothing such as gloves and boots may then also be donned. Before the chemical protection suit 2 is fully donned, the source of breathable gas 6 is turned on resulting in breathable gas being supplied through the fluid lines 12, 13 to the garment 16. The chemical protection suit is then fully sealed with the hood 4 covering the user's head.

Referring to FIG. 12, the breathable gas supplied from the source of breathable gas 6 enters the inlet 108 of the garment manifold 102 and enters the T-piece 104. A proportion of the gas, which in this embodiment is approximately 50%, is supplied into the gas distributor 106 through the outlet 112, whilst the remainder (i.e. the other 50%) of the gas is supplied into a lower portion of the channel 70 of the breathing duct 54. The breathable gas is supplied at a rate of approximately 300 liters/min. It should be appreciated that in other embodiments the proportions of breathing gas and cooling gas may be different, and the flow rate may be any suitable rate. Referring to FIGS. 2 and 8, the breathable gas flows within the central portion 56 of the breathing duct 54, and then flows into the left and right braches 58, 60. Referring to FIG. 2, the gas then exits the breathing duct 54 through the air outlets 66, 68 which directs the gas towards the user's face. The breathable gas is discharged from the air outlets 66, 68 into the interior of the chemical protection suit 2 where it can be inhaled by the user. The air outlets 66, 68, or openings, vent or discharge the breathable gas freely into the ambient surroundings within the protective garment in the region of the user's head. Thus, there is no fluid line provided between the duct outlet and the breathable gas inlet of a delivery device (such as a face mask or hood). The positioning of the air outlets 66, 68 is such that gas is directed towards the user's face, keeping carbon dioxide levels in region of the users face to a safe level. This is an important safety benefit. As the user exhales, the gas exits the chemical protection suit 2 through one-way exhalation valves.

The flexible but semi-rigid nature of the breathing duct 54 allows a user to bend and twist, whilst preventing the breathing duct 54 from being crushed so that the channel 70 is closed. Further, if a user is lying on their back, for example, although it may be deformed, the breathing duct 54 is not completely crushed which would restrict the supply of gas to the user.

Referring to FIG. 14, a proportion of the breathable gas which enters the interior of the gas distributor 106 is discharged into a lower part of the interior (i.e. the chamber) of the bladder 74 which is adjacent to the back temperature control region 94. The remainder of the breathable gas enters the distribution conduits 122 where it flows towards the left and right pectoral portions 82, 84 of the bladder 74. The breathable gas is discharged into the interior of the bladder 74 at positions adjacent to the left and right pectoral temperature control regions 96, 98 respectively. The distribution conduits 122 ensure that the breathable gas is distributed within the bladder 74 to the correct regions.

The breathable gas within the bladder 74 is then discharged from the interior of the bladder towards the user's body through the cooling holes 92. The gas flows through the diffuser layer 100 which causes the gas to be more evenly distributed. This acts to cool the user's body. Specifically, gas is discharged through the holes 92 in the back temperature control region 94, the left pectoral temperature control region 96 and the right pectoral temperature control region 98. This directs gas towards the user's back, left pectoral region and right pectoral region, acting to cool these regions. This targeted cooling acts to cool the user's body temperature, thereby improving the user's comfort. The diffuser layer 100 fits closely to the user's body so that the cooling gas is directed towards the user's body. If the user wishes to alter level of cooling, the adjustable vents 86 can be opened to allow gas to exit the bladder through the outer panel 88 (as opposed to being directed towards the user's body).

The provision of cooling holes in specific targeted cooling regions 94, 96, 98 means that the breathable gas supplied to the garment is efficiently used and gas is not directed to areas which do not require cooling. The Applicant has discovered that cooling the user's back region, left pectoral region and right pectoral region has a particularly beneficial effect (when compared to cooling other parts of the body) on the user's core body temperature. Since the cooling holes are selectively placed in the most appropriate regions, it is not necessary to provide an "all over" garment such as a vest or jacket. Thus, a harness-type garment can be provided which is more comfortable to wear and which conforms more closely to the body of the wearer.

It should be appreciated that in other embodiments cooling holes may be distributed evenly throughout the bladder, or they may be provided in one or more different targeted cooling regions. For example, cooling holes may only be provided in a back temperature control region.

A garment 16 which provides both cooling, and which is capable of delivering breathable gas to a user, is particularly advantageous and results in a compact piece of equipment. It negates the need for a separate cooling garment and breathing apparatus, which may be more complex and expensive. Further, using a single piece of equipment to provide two major functions reduces the number of fluid components and supply lines.

The manifold 102 may be provided with one or more fluid control valves that may allow the proportion of gas supplied to the breathing duct and the bladder to be altered. For example, it may be possible to prevent breathable gas being supplied to the breathing duct or bladder if it is not required. A valve may also be provided to allow the flow rate of gas supplied to the garment 16 to be controlled.

It has been described that the garment 16 is a harness-type arrangement in which there are adjustable shoulder straps. This may be particularly beneficial as it the garment can be adjusted to fit all different body types. Therefore, it is only necessary to manufacture, supply and purchase a single garment of a single size (or at least a small number of garments of different sizes) which can be adjusted to fit all types of users. Further, a harness-type garment may be more comfortable to wear.

As opposed to providing a separate flexible support, the bladder itself may form a support structure. For example, the breathing duct could be directly attached to the bladder as opposed to being coupled to it by the flexible support. Further, in other embodiments the breathing duct could be integrally formed or partially defined by the bladder. For example, the bladder could define a main cooling gas chamber for cooling gas and a breathing duct passage for breathing gas.

It should be appreciated that in other embodiments the garment 16 may take other forms and could be a vest or jacket, for example. In one alternative arrangement, the garment could be a vest having targeted (or non-targeted) cooling regions with a breathing duct attached thereto.

It has been described that the garment 16 is arranged to be worn underneath a chemical protection suit. However, the garment 16 could be worn under any protective garment such as a jacket, for example.

It is not essential that the garment 16 comprises a breathing duct for supplying breathable gas to a user. The garment 16 may therefore only provide a cooling function. For example, the cooling garment 16 could be worn to control the body temperature of a user where breathing apparatus is not necessary (i.e. the ambient air is safe to breathe). Alternatively, the cooling garment 16 could be used in combination with other types of breathing apparatus. In one arrangement, the cooling garment 16 could be incorporated into, or worn under, a harness for self-contained breathing apparatus. If the garment 16 is not required to supply breathable gas to a user, it may not be necessary that the gas supplied to the garment 16 is breathable gas.

Further, in other embodiments the garment 16 may be a breathing apparatus garment only and may not provide any cooling. For example, the garment 16 may only comprise a flexible support, shoulder straps and a breathing duct for delivering breathable gas to a user. Such a garment may be worn underneath a chemical protection suit, for example, so that breathable gas can be supplied to a user. A breathing apparatus garment as described above may be suitable where cooling is not required, or where cooling is provided by other means.

It has been described that the garment 16 is supplied with gas which is used to cool a user's body. However, it should be appreciated that gas may be supplied to warm a user working in cold environments.

Although it has been described that the source of breathable gas is a cylinder of compressed air, it will be appreciated that in other embodiments the source of breathable gas may be a compressed air network (or ring main) installed within a building, or a large tank of compressed air, for example.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

The invention claimed is:

1. A temperature control garment arranged to be worn on a user's torso, comprising:

a flexible bladder defining a chamber for receiving a supply of gas from a source of compressed breathable gas, the flexible bladder comprising at least a back portion, the back portion being arranged to overlie at least a portion of the user's back;

an arrangement of holes provided in a first side of the flexible bladder for directing gas supplied to the chamber towards the user's body so as to modify the temperature of the user's body;

a diffuser layer separate from the flexible bladder and fixedly coupled to the first side of the flexible bladder;

a flexible support coupled to a second side of the flexible bladder; and a breathing duct fixedly coupled to the flexible support for receiving a supply of gas from the source of compressed breathable gas, the breathing duct having at least one duct outlet for delivering the gas supplied to the breathing duct to the user, whereby the diffuser layer is positioned between the user's back and the flexible bladder, and whereby the diffuser layer is configured to direct gas to the back of the user.

2. A garment according to claim 1, wherein the breathing duct is flexible.

3. A garment according to claim 1, wherein the breathing duct longitudinally extends from a lower portion to an upper portion.

4. A garment according to claim 1, wherein the breathing duct is arranged to extend over the left and/or right shoulder of the user.

5. A garment according to claim 1, wherein each duct outlet is arranged to direct gas towards the user's face.

6. A garment according to claim 1, further comprising a manifold having a manifold inlet for receiving a supply of gas, and a first outlet in fluid communication with the chamber for supplying gas to the chamber.

7. A garment according to claim 6, wherein the manifold further comprises a second outlet in fluid communication with the breathing duct for supplying gas to the breathing duct.

8. A gall lent according to claim 6, wherein the manifold inlet is provided with a gas connector for connecting to a flexible conduit.

9. A garment according to claim 6, wherein the manifold comprises a gas distributor disposed within the chamber.

10. A garment according to claim 9, wherein the gas distributor extends transversely, and wherein the manifold includes a plurality of manifold chamber outlets which are transversely spaced.

11. A garment according to claim 6, further comprising at least one distribution conduit disposed within the chamber and in fluid communication with the first outlet, the distribution conduit extending from a distribution conduit inlet at lower region of the chamber to distribution conduit outlet at an upper region of the chamber.

12. A garment according to claim 11, wherein the at least one distribution conduit comprises a plurality of distribution conduits.

13. A garment according to claim 1, wherein the flexible bladder is provided on an inner side of the flexible support.

14. A garment according to claim 1, wherein the flexible bladder is coextensive with the flexible support.

15. A garment according to claim 1, wherein the breathing duct is attached to an outer surface of the flexible support.

16. Personal protective equipment, comprising:

a temperature control garment arranged to be worn on a user's torso having:

a flexible bladder defining a chamber for receiving a supply of gas from a source of compressed breathable gas, the flexible bladder comprising at least a back portion, the back portion being arranged to overlie at least a portion of a user's back;

an arrangement of holes provided in a first side of the flexible bladder for directing gas supplied to the chamber towards the user's body so as to modify the temperature of the user's body;

a diffuser layer fixedly coupled to the first side of the flexible bladder;

a flexible support coupled to a second side of the flexible bladder; and a breathing duct fixedly coupled to the flexible support for receiving a supply of gas from the source of compressed breathable gas, the breathing duct having at least one duct outlet for delivering the gas supplied to the breathing duct to the user; whereby the diffuser layer is positioned between the user's back and the flexible bladder, and whereby the diffuser layer is configured to direct gas to the back of the user; and a protective garment arranged to be worn over the temperature control garment.

17. Personal protective equipment according to claim 16, wherein the temperature control garment is arranged to cover at least a user's torso.

18. Personal protective equipment according to claim 16, further comprising a protective suit or jacket having a hood portion which overlies the temperature control garment, the hood portion being arranged to cover the user's head.

19. A temperature control garment arranged to be worn on a user's torso, comprising:

left and right adjustable shoulder straps;

a flexible support having at least a flexible back panel;

a flexible bladder attached to the inner surface of the flexible support, the flexible bladder defining a bladder chamber for receiving a supply of gas from a source of compressed breathable gas and having at least a back portion, said back portion being arranged to overlie at least a portion of a user's back;

an arrangement of holes provided in a first side of the flexible bladder for directing the compressed breathable gas supplied to the chamber towards the user's body so as to modify the temperature of the user's body; the arrangement of holes being concentrated in one or more targeted temperature control regions;

a diffuser layer fixedly coupled to the first side of the flexible bladder;

a flexible support coupled to a second side of the flexible bladder; and a flexible breathing duct fixedly coupled to the flexible support for receiving the compressed breathable gas, the flexible breathing duct having at least one duct outlet for discharging the compressed breathable gas supplied to the flexible breathing duct into the surroundings, whereby the diffuser layer is positioned between the user's back and the flexible bladder, and whereby the diffuser layer is configured to direct gas to the back of the user.

* * * * *